313-414 SR
5/26/87 OR 4,668,892

United States Patent [19]

Peels

[11] Patent Number: 4,668,892

[45] Date of Patent: May 26, 1987

[54] COLOR DISPLAY TUBE WTIH OVERLAPPING FIELD LENS HAVING A FIELD CORRECTION PLATE

[75] Inventor: Antonius H. P. M. Peels, Eindhoven, Netherlands

[73] Assignee: U.S. Philips Corporation, New York, N.Y.

[21] Appl. No.: 833,570

[22] Filed: Feb. 24, 1986

Related U.S. Application Data

[63] Continuation of Ser. No. 516,029, Jul. 22, 1983, abandoned.

[30] Foreign Application Priority Data

Aug. 25, 1982 [NL] Netherlands ..... 8203321

[51] Int. Cl.[4] ..... H01J 29/62
[52] U.S. Cl. ..... 313/414; 313/449
[58] Field of Search ..... 313/414, 413, 449

[56] References Cited

U.S. PATENT DOCUMENTS 4,406,970 9/1983 Hughes ..... 313/414
4,581,560 4/1986 Shirai et al. ..... 313/460 X

FOREIGN PATENT DOCUMENTS 56-30239 3/1981 Japan ..... 313/414

OTHER PUBLICATIONS

Hosokoshi et al, IEEE Transactions on Consumer Electronics, vol. CE-26, Aug. 1980, pp. 452–458.

*Primary Examiner*—Palmer C. DeMeo
*Assistant Examiner*—Sandra L. O'Shea
*Attorney, Agent, or Firm*—Robert J. Kraus

[57] ABSTRACT

A color display tube has an electron gun system (5) with focusing lens electrodes (25, 26) producing overlapping lens fields. Correction of the overlapping lens fields is accomplished by means of at least one field correction plate (35, 36) which extends substantially perpendicularly to the beam axes and has elongate and/or square apertures (38, 39, 40) through which the electron beams pass.

5 Claims, 5 Drawing Figures

COLOR DISPLAY TUBE WTIH OVERLAPPING FIELD LENS HAVING A FIELD CORRECTION PLATE

This is a continuation of application Ser. No. 516,029, filed 22 July 1983, now abandoned.

BACKGROUND OF THE INVENTION

The invention relates to a colour display tube comprising in an evacuated envelope composed of a neck, a cone and a display window, an electron gun system of the O.L.F.-type (O.L.F.=Overlapping Lens Field) by which three electron beams are generated. The beams are situated with their axes in one plane and are focused on a display screen provided on the inside of the display window by means of focusing lenses. The focusing lenses are generated between apertured, plate-shaped parts of electrodes extending perpendicularly to the beam axes by applying suitable potentials. The apertures communicate with each other so that one elongate aperture is formed in each electrode, and correction means for correcting the focusing lenses are provided in at least one of the electrodes.

Such a colour display tube having an electron gun system of the O.L.F.-type is known from I.E.E.E. Transactions on Consumer Electronics, Vol. C.E.- 26, August 1980, pages 452–458. The focusing properties of focusing lenses deteriorate as their diameter decreases. In an electron gun system having three juxtaposed beams located in one plane the focusing lenses are chosen to be large so as to produce good focusing; the distance between the electron beams must also be chosen to be large. In that case, a glass envelope having a neck of a comparatively large diameter must be used to be able to accommodate the electron gun system. It is more difficult to cause three electron beams which are situated comparatively far from each other to converge on the display screen than three electron beams which are situated close together. The O.L.F. electron gun system described in the I.E.E.E. publication makes it possible to nevertheless use three juxtaposed electron guns with focusing lenses of a large diameter in a colour display tube having a neck of a comparatively small diameter. For that purpose the O.L.F. electron gun system uses overlapping focusing lens fields as a result of which the diameter of the focusing lenses is increased without making the distance between the electron beams larger. The overlapping focusing lens fields are generated with two electrodes in which peanut-shaped apertures are provided in the plate-shaped part which extends perpendicularly to the beam axes. By a peanut shaped aperture is meant an elongate aperture formed by three overlapping circular apertures. Viewed in the direction of propagation of the electron beam, the peanut-shaped apertures are divided, at the area of the constrictions of the peanut-shaped apertures, into three juxtaposed substantially circular apertures by means of separating electrodes. The separating electrodes are metal plates extending perpendicularly away from the plate-shaped part with the peanut-shaped aperture. By providing the separating electrodes with which a correction field is generated, the three focusing lenses formed in this manner are substantially circular so that good focusing properties are obtained. A disadvantage of the above-mentioned construction is that the electron gun systems are difficult to manufacture because the location, shape and orientation of the plate-shaped separating electrodes are very critical.

SUMMARY OF THE INVENTION

It is therefore an object of the invention to provide a colour display tube having an electron gun system of the O.L.F.-type in which the electron gun system is provided with correction means which can be simply manufactured and positioned. For that purpose, according to the invention, a colour display tube of the kind described in the opening paragraph is characterized in that the correction means comprises a field correction plate which extends substantially perpendicularly to the beam axes, which has elongate and/or square apertures through which the electron beams pass, and which is provided near the elongate aperture in the electrode.

The elongate apertures in the field correction plate may be rectangular or oval.

The invention is based on the recognition of the fact that the greater part of the spreading in astigmatism and static convergence of the electron beams of a large number of electron gun systems is caused by inaccurate positioning of the separating electrodes during assembly. The field correction plate as used in the colour display tube in accordance with the invention may be constructed as the bottom of a cup-shaped correction element which is provided coaxially in at least one of the cup-shaped electrodes of the focusing lenses. The apertures in the field correction plate which influence the lens dimensions and the astigmatism can be provided much more accurately than the known separating electrodes. The locations and dimensions of the apertures in the field correction plate can be accurately fixed during the manufacture of said field correction plate. For example, the apertures can be etched accurately in the or provided by spark erosion in the plate. It is also possible to punch the apertures in the plate.

Such a field correction plate can be used in focusing lenses formed between electrodes having peanut-shaped apertures. For reasons of tolerance, however, it is preferable to not make the elongate apertures in the electrodes of the focusing lenses peanut-shaped, but to make them substantially rectangular, the short sides of the rectangle being curved outwardly. The elongate apertures may be oval-shaped.

In Netherlands Patent Application No. 8203322, corresponding to U.S. patent application Ser. No. 516,016, filed 22 July 1983, a colour display tube is described having an electron gun system with a field correction plate with which astigmatism errors and static convergence errors are corrected. In this case, however, it is not an O.L.F. electron gun system in which errors resulting from the overlapping lens fields are corrected. The apertures in the field correction plate in the electron gun system of the colour display tube according to the invention may also be oval as in the field correction plate according to the above-mentioned Netherlands Patent Application.

BRIEF DESCRIPTION OF THE DRAWING

The invention will now be described in greater detail, by way of example, with reference to a drawing, in which.

DESCRIPTION OF THE PREFERRED EMBODIMENTS

Figure 1:
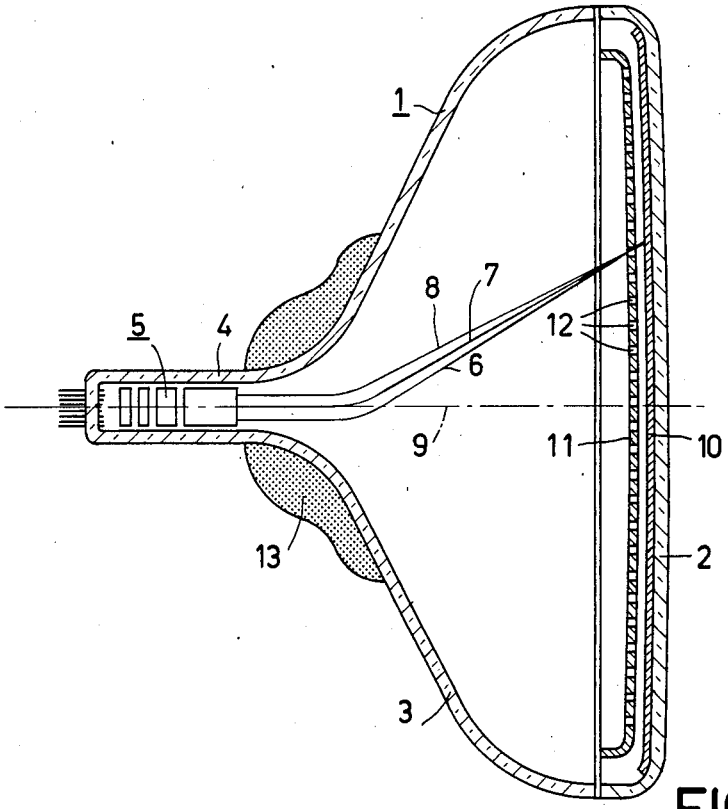
FIG. 1 is a longitudinal sectional view of a colour display tube according to the invention.

FIG. 1 is a longitudinal sectional view of a colour display tube of the so-called "in-line" type. In the neck of a glass envelope 1 which is composed of a display window 2, a cone 3 and a neck 4, is provided an integrated O.L.F. electron gun system 5 which generates three electron beams 6, 7 and 8 which are situated with their axes in the plane of the drawing. The axis of the central electron beam 7 initially coincides with the tube axis 9. The display window 2 has a large number of triplets of phosphor lines on its inside. Each triplet comprises a line consisting of a blue-luminescing phosphor, a line consisting of a green-luminescing phosphor, and a line consisting of a red-luminescing phosphor. All triplets together constitute the display screen 10. The phosphor lines are perpendicular to the plane of the drawing. In front of the display screen a shadow mask 11 is positioned in which a large number of elongate apertures 12 are provided through which the electron beams 6, 7 and 8 pass, each of which beams impinge only on phosphor lines of one colour. The three electron beams situated in one plane are deflected by a system 13 of deflection coils.

Figure 2:
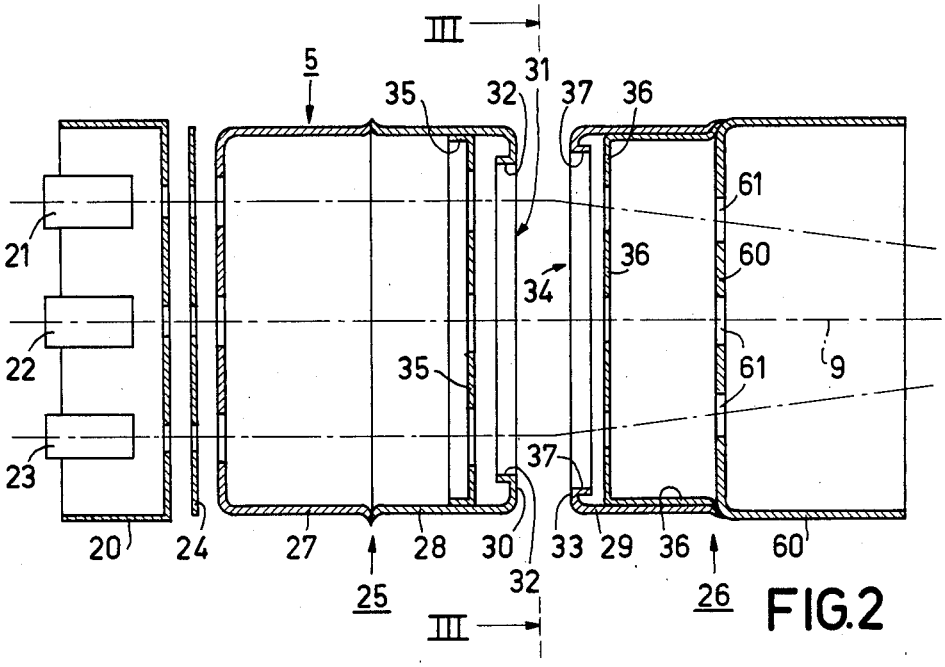
FIG. 2 is a longitudinal sectional view of an electron gun system as used in the colour display tube of FIG. 1.

FIG. 2 is a longitudinal sectional view of the O.L.F. electron gun system as used in the colour display tube shown in FIG. 1. The electron gun system comprises a common cup-shaped control electrode 20, in which three cathodes 21, 22 and 23 are connected, and a common plate-shaped anode 24. The three electron beams situated with their axes in one plane are focused by means of the electrodes 25 and 26 which are common to the three electron beams. Electrode 25 consists of two cup-shaped parts 27 and 28 which are connected together with their open ends. Electrode 26 comprises one cup-shaped part 29 and centering sleeve 60, the bottom of which comprises apertures 61 through which the electron beams pass. The bottom 30 of the cup-shaped part 28 of electrode 25 has a substantially rectangular aperture 31 the short sides 32 of which rectangle are curved outwardly.

Figure 3:
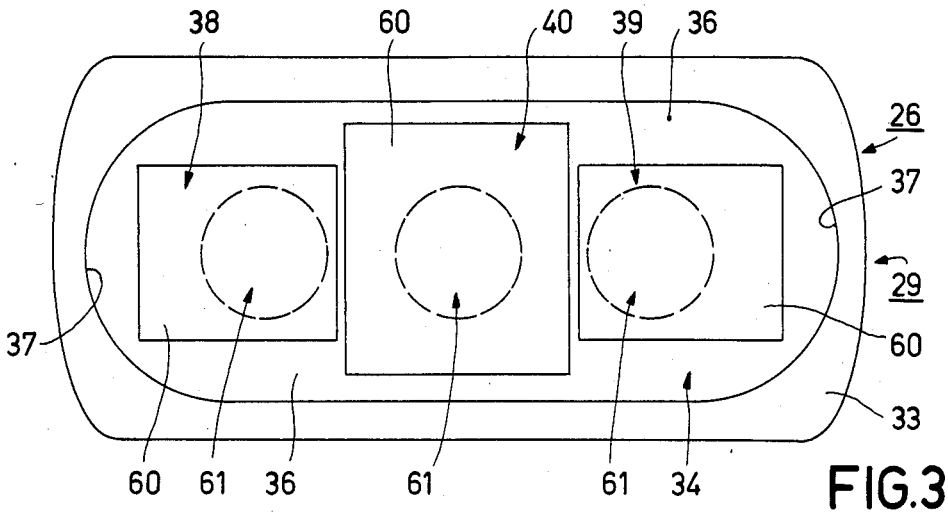
FIG. 3 is an elevation of a lens electrode component of FIG. 2.

The bottom 33 of cup-shaped part 29 of electrode 26 also has such an aperture 34 (see also FIG. 3). The part 28 and the part 29 contain field correction plates 35 and 36, respectively. The overlapping lens fields are corrected by means of the field correction plates.

FIG. 3 is an elevation of part 29 of lens electrode 26 of FIG. 2. Electrode 26 comprises a cup-shaped part 29 having a bottom 33 provided with an elongate aperture 34 which is substantially rectangular and the short sides 37 of which are curved outwardly. The field correction plate 36, which comprises the elongate apertures 38 and 39 and the square aperture 40 extends parallel to bottom 33. The bottom of centering sleeve 60 has apertures 61.

Figure 4:
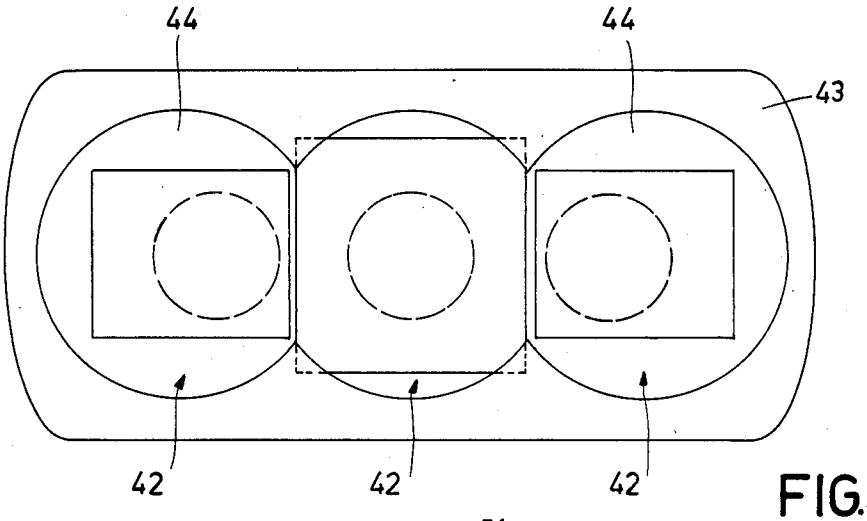
FIG. 4 shows an alternative for the construction shown in FIG. 3.

FIG. 4 shows an alternative to the FIG. 3 construction. Aperture 42 in bottom 43 of a cup-shaped electrode in this case is peanut-shaped. The field correction plate 44, which is like the plate 36 of FIG. 3 extends parallel to the bottom 43.

Figure 5:
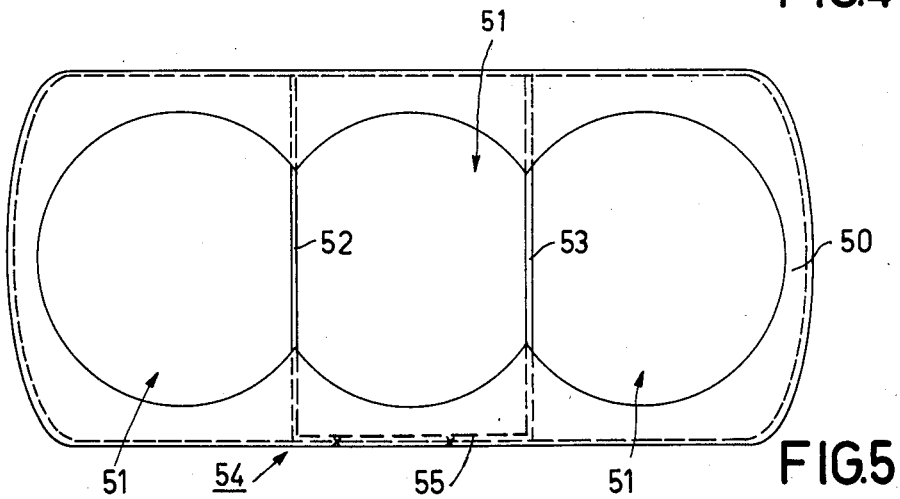
FIG. 5 is an elevation of a prior art O.L.F. lens component.

FIG. 5 is an elevation of a prior art O.L.F. lens component. A peanut-shaped aperture 51 is provided in the bottom 50 of a cup-shaped electrode 54. The separating electrodes 52 and 53 are formed by the limbs of a U-shaped strip of metal 55 the surface of which extends substantially parallel to the beam axes (perpendicularly to the plane of the drawing). The U-shaped strip is welded to the electrode wall in the electrode behind the bottom 50. This must be done very accurately since a small deviation in location and direction of the separating electrodes 52 and 53 will result in an incorrect influence on the electron beam. The apertures in the field correction plate as used in a colour display tube according to the invention can be provided very accurately prior to the assembly of the electron gun system. The dimensions and location of the apertures can be calculated and/or established experimentally in each type of gun. As a result of this it becomes possible to manufacture a large number of substantially identical O.L.F. electron gun systems with smaller errors in the astigmatism and the static convergence of the electron beams. The use of one or more field correction plates is, of course, also possible in O.L.F. electron gun systems having focusing lenses consisting of more than two electrodes. This is the case, for example, in focusing lenses of the unipotential type consisting of three electrodes, the first and the last electrode of which have the same potentials. Another possibility is to use focusing lenses of the multipotential type consisting of a number of electrodes which, during operation of the colour display tube, carry different potentials. It is also possible, for example, to focus with four successive electrodes which may be interconnected differently.

What is claimed is:

1. In a color display tube comprising an evacuated envelope containing a luminescent screen and an electron gun system for producing a central electron beam and first and second outer electron beams lying in a single plane, said electron gun system including first and second spaced-apart focusing lens electrodes, each having a portion with a single elongate aperture, for cooperatively producing therebetween overlapping central and first and second outer focusing lenses for individually focusing the corresponding electron beams;

an improved one of said electrodes comprising first and second spaced-apart plates, said first plate having the respective single elongate aperture and being closer to the other electrode than the second plate, and said second plate having non-overlapping central and first and second outer apertures, the single aperture in said first plate being shaped to define the outer bounds of the overlapping lenses, and the apertures in said second plate being shaped and positioned relative to the single aperture in the first plate to define the bounds of the overlapping portions of the lenses and to establish symmetry of the lenses.

2. A color display tube as in claim 1 where the apertures in the field correction plate are rectangular.

3. A color display tube as in claim 1 where the apertures in the second correction plate are oval.

4. A color display tube as in claim 1, 2 or 3 where the elongate aperture in at least one of said first and second electrodes is substantially rectangular.

5. A color display tube as in claim 4, where the elongate aperture in at least one of said first and second electrodes is defined by two longer parallel sides and two shorter outwardly-curved sides.

* * * * *